US006508318B1

(12) United States Patent
Lindén et al.

(10) Patent No.: US 6,508,318 B1
(45) Date of Patent: Jan. 21, 2003

(54) PERCUSSIVE ROCK DRILL BIT AND BUTTONS THEREFOR AND METHOD FOR MANUFACTURING DRILL BIT

(75) Inventors: Johan Lindén, Gävle (SE); Lars-Gunnar Lundell, Sandviken (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/722,006

(22) Filed: Nov. 27, 2000

(30) Foreign Application Priority Data

Nov. 25, 1999 (SE) ..... 9904273

(51) Int. Cl.[7] ..... E21B 10/36

(52) U.S. Cl. ..... 175/414; 175/420.1; 299/100; 299/111

(58) Field of Search ..... 175/414, 420.1, 175/426, 431, 435; 299/113, 100, 111

(56) References Cited

U.S. PATENT DOCUMENTS 4,014,395 A * 3/1977 Pearson ..... 175/426
4,296,825 A * 10/1981 Larsson ..... 175/417
4,595,067 A * 6/1986 Drake ..... 175/331
4,854,405 A * 8/1989 Stroud ..... 175/374
5,286,549 A 2/1994 Hartzell et al.
5,379,854 A * 1/1995 Dennis ..... 175/426
5,647,449 A * 7/1997 Dennis ..... 175/426
5,845,547 A * 12/1998 Sollami ..... 175/420.1
5,848,657 A * 12/1998 Flood et al. ..... 175/426
5,890,551 A * 4/1999 Liljebrand et al. ..... 175/414
6,196,340 B1 * 3/2001 Jensen et al. ..... 175/431
6,202,768 B1 * 3/2001 Lindgren et al. ..... 175/385
6,220,376 B1 * 4/2001 Lundell ..... 175/430

FOREIGN PATENT DOCUMENTS

GB 2 348 899 10/2000

* cited by examiner

*Primary Examiner*—David Bagnell
*Assistant Examiner*—Daniel P Stephenson
(74) *Attorney, Agent, or Firm*—Burns, Doane, Swecker & Mathis, LLP

(57) ABSTRACT

A percussive rock drill bit includes a head portion with a forward surface surrounded by a peripheral surface. The peripheral surface supports a wreath of peripheral buttons. Front buttons are mounted to the forward surface inside the wreath of peripheral buttons. The button shave a diameter (D) and a height (H), wherein H/D<1.2. The buttons are welded to an essentially flat part of the forward surface whereby the buttons are metallurgically bound to the head portion.

6 Claims, 5 Drawing Sheets

PERCUSSIVE ROCK DRILL BIT AND BUTTONS THEREFOR AND METHOD FOR MANUFACTURING DRILL BIT

BACKGROUND OF THE INVENTION

The present invention relates to a method for the manufacturing of a drill bit for percussive rock drilling, as well as to a rock drill bit and a button for use in percussion drilling operations.

PRIOR ART

A rock drill bit is intended to crush rocks. This is achieved by generating impacts or shock waves in a drilling machine and transferring those via a rod to the end where the drill bit is secured. The crushing is achieved by so called buttons or chisels of hard metal, which are positioned in the front surface of the steel drill body. The buttons and the chisels are subjected to high strains during impacting. Today the buttons or the chisels are secured by being pressed into drilled holes or by being soldered in milled grooves. In drilled holes, buttons are held by friction to the bore wall or, in case of chisel bits, with the assistance of brazing material. During brazing, a material often is applied having relatively low strength and which melts at low temperature, which limits the strength of the joint.

The bending moment on a button must be resisted by the bore hole in the drill body, so relatively deep holes are required in the drill body. By "deep" is meant holes in the magnitude of 5–20 mm, depending of the dimensions of the hard metal. Due to the deepness of the holes, the geometry of the drill body must be oversized. Since the volume of the drill body is limited, also the number of buttons and their possible positions become limited. Thereby the options for positioning of flush channels for flushing fluid in the drill body become limited. In addition, only a smaller part of the hard metal of the button is used for machining. In case the buttons are diamond coated, the heat from brazing can damage the diamond layer.

OBJECTS OF THE INVENTION

One object of the present invention is to provide a method for the manufacturing of drill bits for percussive rock drilling, and to provide a rock drill bit and a button, which counteract the above-captioned drawbacks.

Another object of the present invention is to provide a rock drill bit, which allows great versatility regarding the creation of cavities in the drill body.

Still another object of the present invention is to provide a button, which enables a simple mounting to the drill body.

Still another object of the present invention is to provide a method for the manufacturing of drill bits for percussive rock drilling, which is fast and efficient.

SUMMARY OF THE INVENTION

One aspect of the present invention relates to a rock drill bit for percussive drilling which comprises a bit body having a working end formed by a forward surface and a surrounding peripheral surface. Peripheral buttons are arranged in the peripheral surface in the form of a peripheral wreath of peripheral buttons. Front buttons are arranged in the forward surface inside of the wreath of peripheral buttons. At least one of the front buttons is welded to a substantially flat portion of the forward surface. The at least one button has a protruding portion which protrudes from the forward surface. The protruding portion has a diameter D and a height H, wherein H/D<1.2. The at least one button is metallurgically bound to the forward surface.

Another aspect of the invention relates to a method of manufacturing a rock drill bit for percussive drilling. The bit comprises a body having a head portion on which a working end of the button is disposed. The working end comprises a forward surface and a surrounding peripheral surface. Peripheral buttons are arranged in the peripheral surface to form a wreath of peripheral buttons. Front buttons are arranged in the forward surface. Each peripheral and front button includes a protruding portion protruding forwardly from the working end. The protruding portion has a maximum diameter D and a height H. The method comprises the steps of:

A) providing a source of current having two electric poles,

B) connecting one of the poles to the bit body and the other pole to at least one of the buttons having a ratio of H/D<1.2, C) converging the forward surface and the at least one button such that an electric arc is formed between the forward surface and the button, the electric arc melting opposing faces of the forward surface and the button, D) pressing the button against the forward surface, E) allowing the opposing faces to solidify, and F) repeating steps A–E for other buttons of the bed having a ratio H/D<1.2.

BRIEF DESCRIPTION OF THE DRAWING

The objects and advantages of the invention will become apparent from the following detailed description of preferred embodiments thereof in connection with the accompanying drawing, in which like numerals designate like elements, and in which.

DETAILED DESCRIPTION OF PREFERRED EMBODIMENTS OF THE INVENTION

Figure 1:
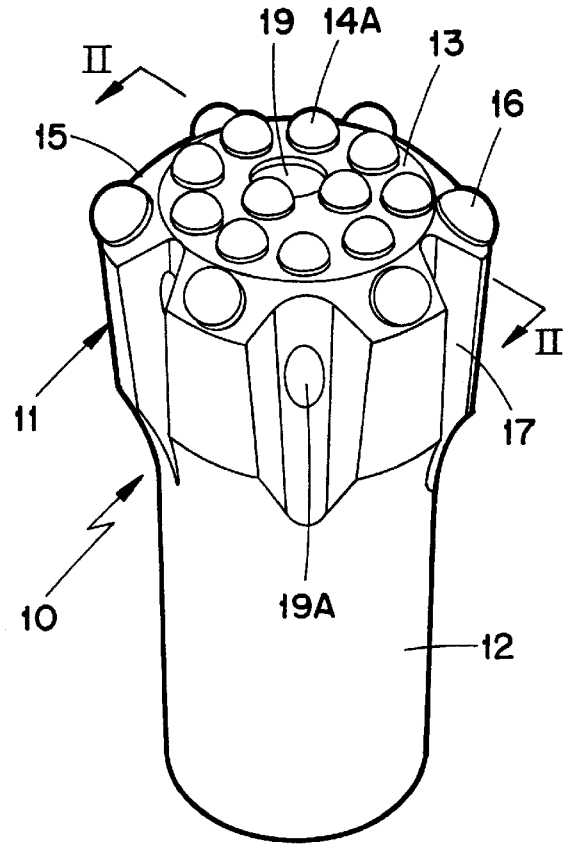
FIG. 1 shows a rock drill bit according to the present invention in a perspective view.
Figure 2A:
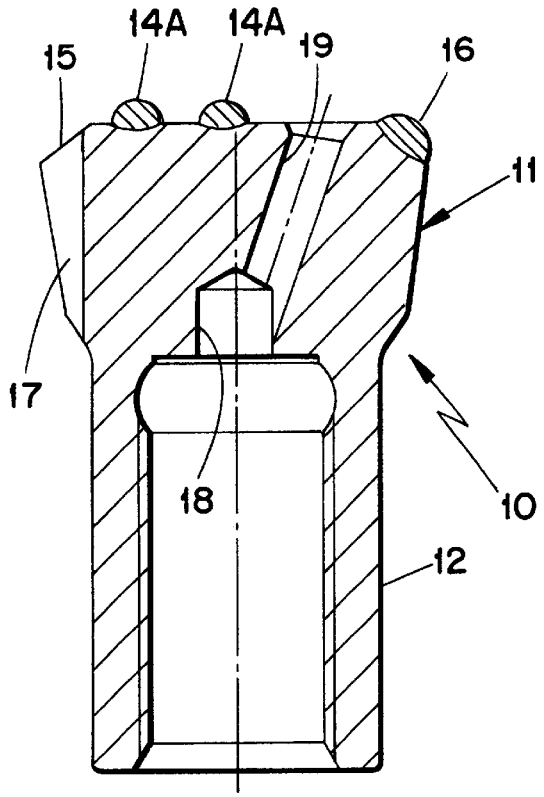
FIG. 2A shows the drill bit in a cross-section according to line II—II in FIG. 1.
Figure 2B:
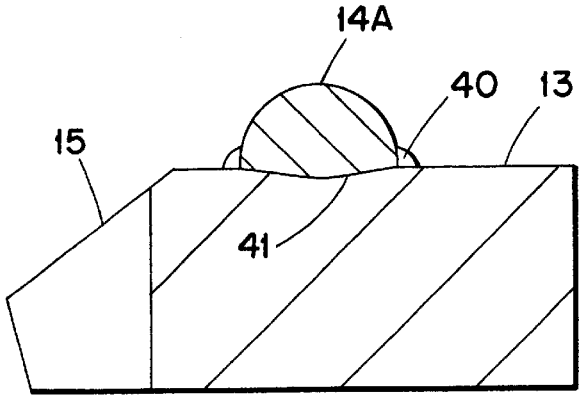
FIG. 2B shows a fragment of FIG. 2A depicting the drill bit in an enlarged cross-section.
Figure 3A:
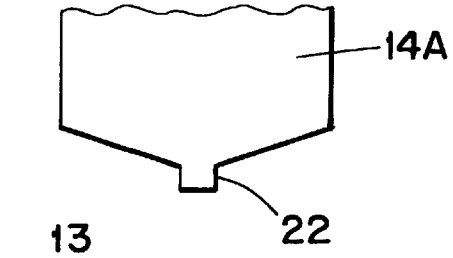
FIGS. 3A–3G schematically show a process according to the present invention with spot welding of a button to a drill body.
Figure 3B:
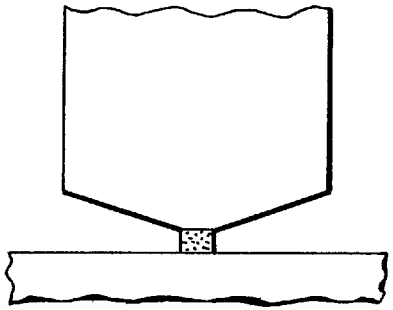
Figure 3C:
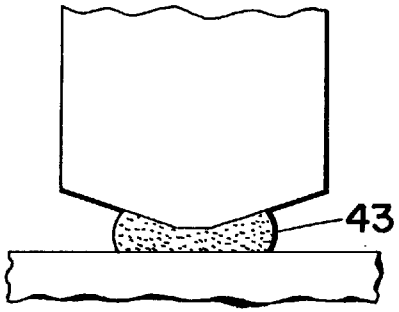
Figure 3D:
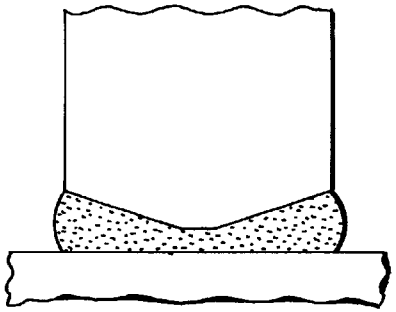
Figure 3E:
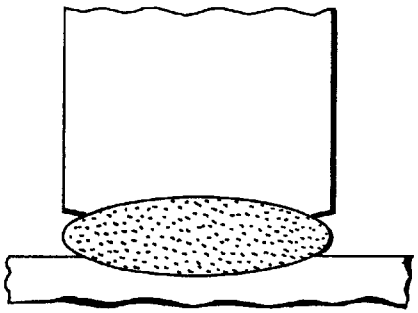
Figure 3F:
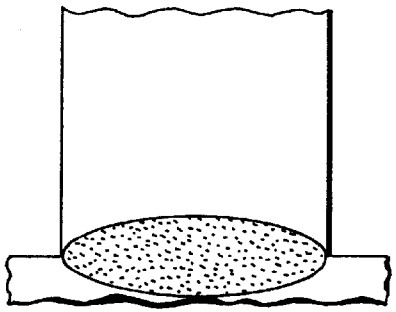
Figure 3G:
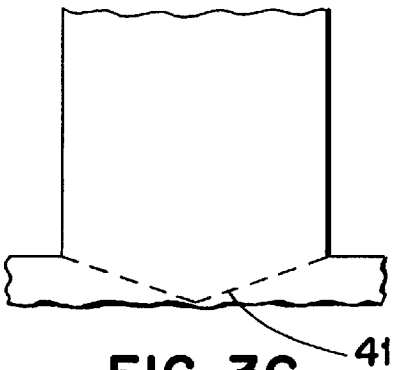

In FIGS. 1, 2A and 2B is shown a rock drill bit 10, which in a conventional manner comprises a substantially cylindrical head portion 11 and a thinner shank 12. The head portion 11 has a working end comprised of a front surface 13 and a peripheral surface 15. A number of front buttons 14A are assembled on the front surface 13. The peripheral surface portion 15 between the front surface 13 and the outer periphery of the head portion is conically shaped. A number of peripheral buttons 16 are arranged on this conical surface portion 15 in the form of a peripheral wreath of buttons 16.

The front buttons 14A and the peripheral or gauge buttons 16 may be identical. Parts of the peripheral buttons 16 extend somewhat radially outside the periphery of the head portion such to drill a hole which has a bigger diameter than the head portion. In areas between adjacent peripheral buttons 16 recesses 17 are provided through which flush medium (e.g., water or air) can pass. As is evident from FIG. 2A a main channel 18 for flush medium is provided internally in the drill bit. This main channel transforms at its forward end into a number of branch channels 19A, 19, some of which (19A) terminate in said recesses 17 and another of which (19) terminates in the front surface. At least one of the front buttons 14A is provided close to the orifice of the channel and basically axially in front of the branch channel 19. The shape of the button front end may vary considerably; it can thus be semi-spherical, conical, ballistic or semi-ballistic.

The buttons are made from wear resistant hard metal, such as wolfram carbide and cobalt pressed together whereafter the formed body is sintered. Since hard metal is an expensive material, the cost of the drill bit would fall significantly if the hard metal portion of a conventional button that normally is pressed downwards into the hole in the steel body could be eliminated. The manufacturing cost should also be lower if hole drilling did not have to be performed to receive such hard metal portions. In the present invention the hard metal is directly secured to the steel body by welding. Welding means that the surfaces are heated and pressed together such that a so-called metallurgical bond with high strength is obtained between the two materials.

A problem with the welding of hard metal is the high carbon content. The carbon content in the steel closest to the joint will increase at melting, with the risk of brittleness. To limit this the welding time is chosen short, which puts special demands on the choice of welding method.

A suitable welding method where specifically short welding time is characteristic is capacitor discharge spot welding, which is illustrated in FIGS. 3A–3G. The method involves connecting the button 14A and the work piece 13 to a circuit in which a capacitor pack, not shown, is discharged. A specially formed tip 22 in the button makes the current very high locally, and an electric arc 43 arises. This electric arc vaporizes the tip and melts the surfaces. The button is pressed or pushed against the work piece wherein the melt solidifies and a metallurgical or chemical bond arises. The course of welding is very fast, in the magnitude of 1–5 milliseconds (ms), and its progression is shown in FIGS. 3A–3G. Welding can also be made without a gap, i.e., without step A in the figure, and then the welding time becomes somewhat longer but no longer than 1 second. The method steps according to the present invention with reference to FIGS. 3A–3G consequently comprise:

A) the capacitor pack is charged and the button 14A is accelerated towards the work piece 13;

B) the tip 22 engages the work piece 13 and short circuits the capacitor pack;

C) the tip 22 is vaporized and an electric arc 43 is formed between the button and the work piece;

D) the arc expands;

E) the electric arc melts the surface layer of both materials;

F) the button is pushed against the work piece and welds the materials; and

G) the melt layers immediately solidify in an essentially conical weld joint 41 and the welding is finished.

In FIGS. 2A and 2B can be seen that the solidified material, mostly steel, forms an upset 40 around each button. The thickness of the weld joint lies within the interval of 1–300 micrometer ($\mu$m).

Figure 4:
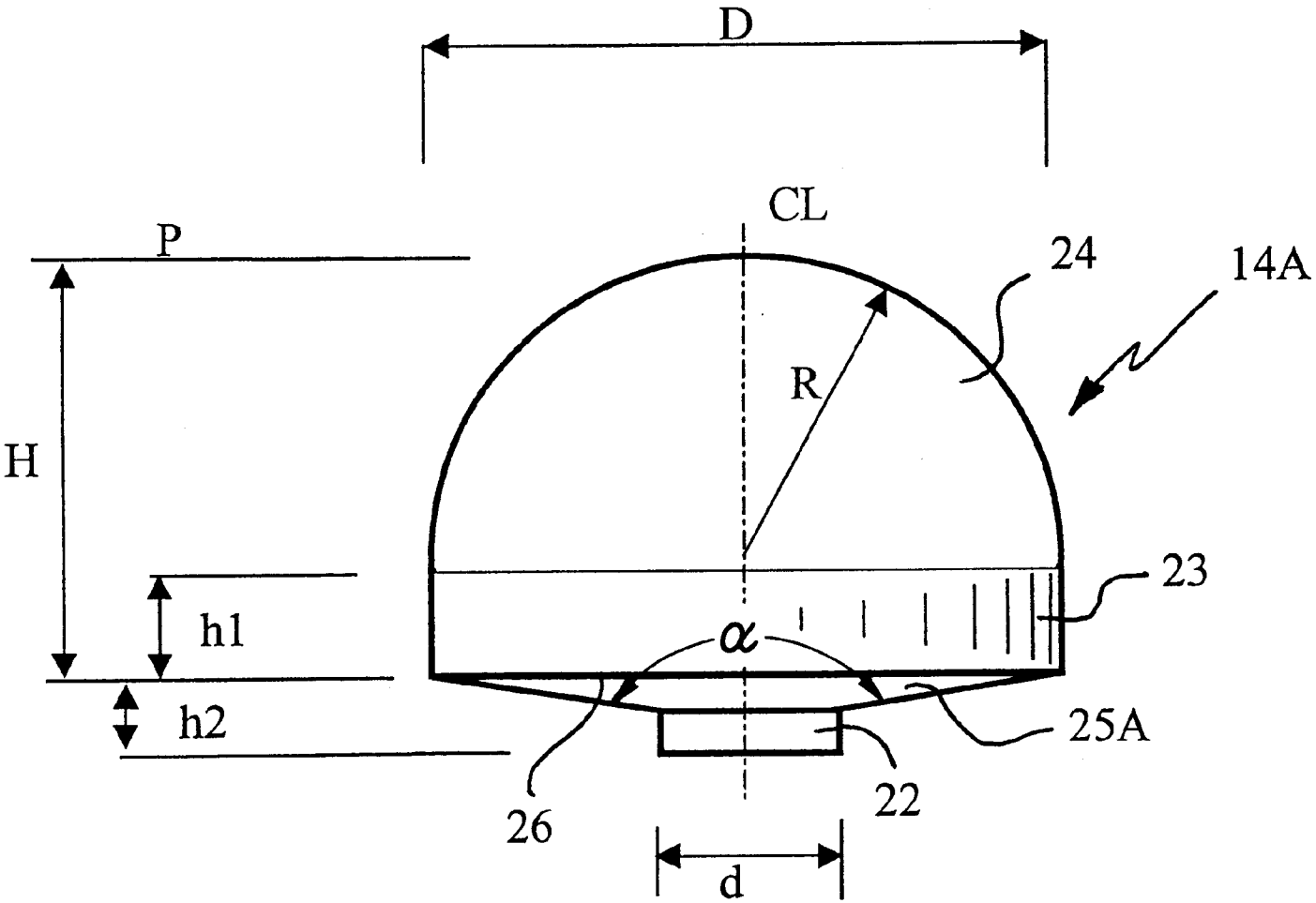
FIG. 4 shows a button according to the present invention in a side view.
Figure 5A:
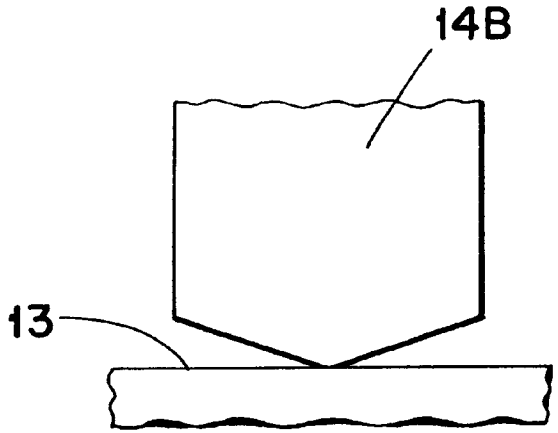
FIGS. 5A–5F schematically show an alternative process according to the present invention involving spot welding of a button to a drill body.
Figure 5B:
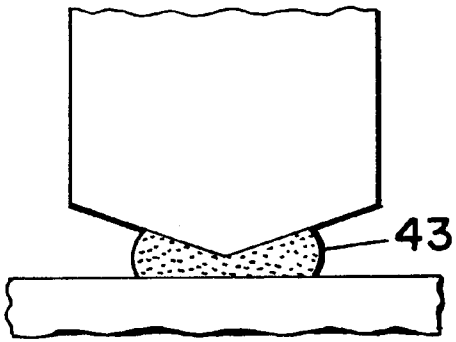
Figure 5C:
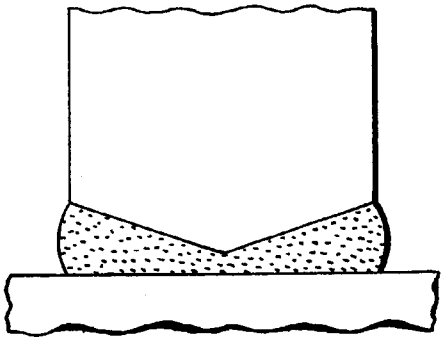
Figure 5D:
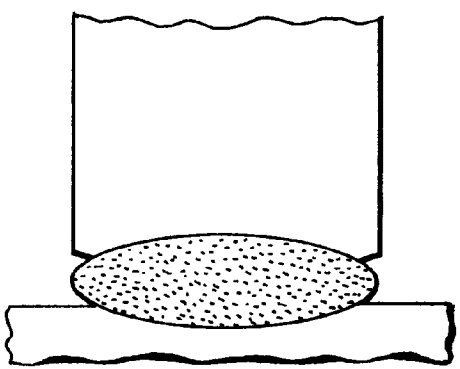
Figure 5E:
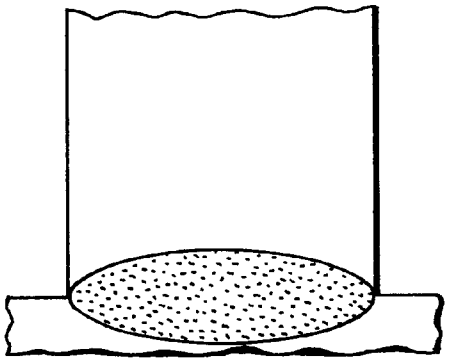
Figure 5F:
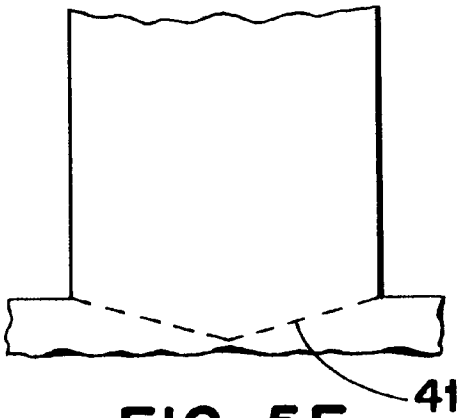

The button 14A, whose configuration has been adapted to the method according to the present invention, is shown in FIG. 4. The button of hard metal has a substantially cylindrical shank portion 23 and a semi-spherical working end or end surface 24. The button has a center axis CL. The end surface is defined by a radius R, the center of which lies in a plane P. The shank portion 23 has a diameter D. The tip 22 extends symmetrically about the central axis CL from a lower side 25A of the button. The lower side 25A is substantially conical in shape and defines an internal cone angle , which is from 150° to less than 180°, i.e., preferably from 150° to about 174°. The tip has a diameter D of about 0.75 mm. The shank portion 23 has a height h1 extending from the plane P to a transition 26 between the shank portion 23 and the lower side 25A, the height h1 being from 0.2 to 2.8 mm. The tip 22 and the lower side 25A have a height h2 of about 1.2 mm measured from the transition 26 to the bottom of the tip 22. The height H of the button constitutes a height of a protruding part of the button which is to protrude from the front surface of the bit body, and the height H is defined from transition 26 to the top of the button, that is H=h1 +R, and is from 3.3 to 10.7 mm. Suitable values regarding button dimensions for buttons used in percussive rock drilling according to the present invention (including the most common button diameters for percussive rock drilling) have been listed in the table below. When applicable, the units for the numbers in the table are millimeters.

| Diameter D | Prutrusion H | H-h1 | Cyl. Part h1 | H/D |
|---|---|---|---|---|
| 7 | 3.32 | 2.2 | 1.12 | 0.47 |
| 7 | 4.87 | 3.9 | 0.97 | 0.70 |
| 8 | 3.97 | 2.6 | 1.37 | 0.50 |
| 8 | 4.77 | 4.5 | 0.27 | 0.60 |
| 9 | 4.25 | 2.8 | 1.45 | 0.47 |
| 9 | 6.25 | 5 | 1.25 | 0.69 |
| 10 | 4.85 | 3.2 | 1.65 | 0.49 |
| 10 | 6.45 | 5.8 | 0.65 | 0.65 |
| 11 | 4.85 | 3.6 | 1.25 | 0.44 |
| 11 | 7.45 | 6.3 | 1.15 | 0.68 |
| 12 | 5.02 | 3.9 | 1.12 | 0.42 |
| 12 | 7.72 | 7.1 | 0.62 | 0.64 |
| 13 | 5.61 | 4.1 | 1.51 | 0.43 |
| 13 | 8.71 | 7.5 | 1.21 | 0.67 |
| 14 | 6.41 | 4.5 | 1.91 | 0.46 |
| 14 | 9.31 | 8 | 1.31 | 0.67 |
| 16 | 7.86 | 5.1 | 2.76 | 0.49 |
| 16 | 10.66 | 9.3 | 1.36 | 0.67 |
| max | 10.66 | 9.3 | 2.76 | 0.70 |
| min | 3.32 | 2.2 | 0.27 | 0.42 |

The H/D ratio is in the range about 0.4 to 0.7 as is evident from the table, but is definitively smaller than 1.2, i.e. H/D<1.2. If the entire length of the button (i.e., H+h2) is compared to the corresponding length of a conventional button it will be seen that the length of the button according to the present invention is about only a third of the length of the conventional button.

Welding may alternatively be made through resistance welding, which is illustrated in FIGS. 5A–5F. Heat is generated by means of electric current, which is conducted through two surfaces held together under pressure. Especially suitable are two procedures, which resemble capacitor discharge spot welding, namely the so-called SC (Short Cycle) and ARC methods. The difference compared to capacitor discharge spot welding is that a transformer current source is used and the button has a wholly conical lower side instead of a tip. The button is in contact with the work piece from the start but is lifted up a short distance simultaneous as the current is turned on. Thereby an electric arc is formed which melts the surfaces in the manner as described above. Finally the button is pushed downwards into the work piece and the weld is formed. The welding time, which is somewhat longer than for capacitor discharge spot welding, is controlled through regulation of the time between the ignition of the electric arc and when the button is pushed downwards. The SC method is illustrated in FIGS. 5A–5F. The SC method steps according to the present invention with reference to FIGS. 5A–5F consequently comprise:

A) the button is initially in contact with the work piece;

B) simultaneously as the current is turned on, the button is lifted from the work piece whereby an electric arc 43 is formed between the button and the work piece;

C) the arc expands;

D) the electric arc melts the surface layer of both materials;

E) the button is pushed into the work piece and welds the materials;

F) the melt layers immediately solidify and the weld joint 41 is finished. The welding time for the SC method seldom exceeds 20 ms.

G) the welding time for the SC method seldom exceeds 20 ms.

Figure 6:
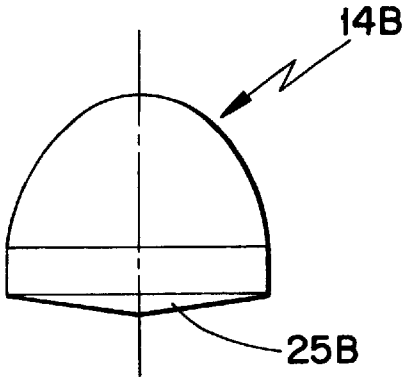

The button 14B that has been adapted to the alternative welding method according to the present invention is shown in FIG. 6. The difference between the button 14B and the above-described button 14A is that the button 14B does not have a tip and therefore the lower side 25B consists of a wholly conical surface with an inner cone angle about 166°. An important common feature for both buttons 14A and 14B is that they have a lower side whose smallest diameter is smaller than the diameter D of the button, i.e. a substantially conical weld joint 41 is obtained. That compensates for a greater degree melting of the steel which normally arises at the mid section of the button.

The ARC method is used for bigger dimensions and functions in the same manner as the SC method. Since longer welding times are used, the weld in this case is protected by means of a ceramic ring or gas. The welding time depends on the diameter, for example a time of 200–400 ms for a button with a diameter of 10 mm, but seldom or never exceeds 1 second.

The hard metal can be covered with a layer of nickel or cobalt before welding, to increase strength of the joint.

EXAMPLE 1

Hard metal buttons with a diameter of 7 mm were welded by means of capacitor discharge spot welding to a steel body in a tempered steel of the TYPE SS2244. The hard metal buttons were shaped according to FIG. 4. During the welding a lifting height of 1 mm was used, the voltage was 160 V and the pressure was 50 N for a welding time of 3 ms. Through metallographical investigation, it was authenticated that a metallurgical bond was obtained between the steel body and the hard metal buttons.

EXAMPLE 2

Hard metal buttons with a diameter of 7 mm were welded by means of the SC method to a steel body in a tempered steel of the TYPE SS2244. The hard metal buttons were shaped according to FIG. 6. During the welding a lifting height of 1 mm was used, the voltage was 550 V during the welding time of 20 ms. Through metallographical investigation, it was authenticated that a metallurgical bond was obtained between the steel body and the hard metal.

An additional advantage occurring from the welding methods according to the present invention is that more buttons can be positioned on the front surface of the drill bit to obtain better machining, i.e. a higher penetration rate. The buttons can be secured by welding also on the smooth, conical surface portion 15. The short welding time enables the welding also of diamond coated buttons. Each button 14A, 14B according to the present invention, which is to be welded, is shorter in length than a corresponding conventional button, and thus expensive hard metal is saved. In addition, there is no need for preparation of the weld joint on the head portion 11. The button 14A, 14B is not intended to be rotated during welding and therefore could be asymmetrically shaped about its axis and thus needs no driving surfaces. In the asymmetric case, in the formula $H/D<1.2$, the letter "D" represents the biggest width of the asymmetrical button. The height hi of the shank of the asymmetric button may be 0 to 15 mm, i.e. its working surface 24 may connect for example directly to the lower side 25A, 25B.

Figure 8:
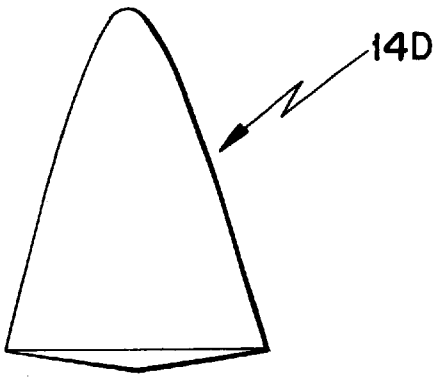
FIGS. 6–10 show alternative embodiments of buttons according to the present invention in side views.
Figure 7:
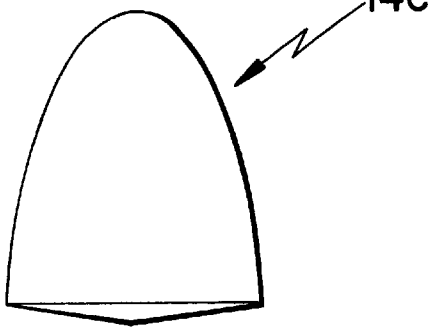
Figure 9:
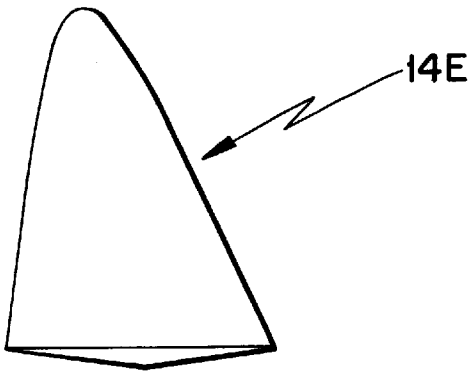
Figure 10:
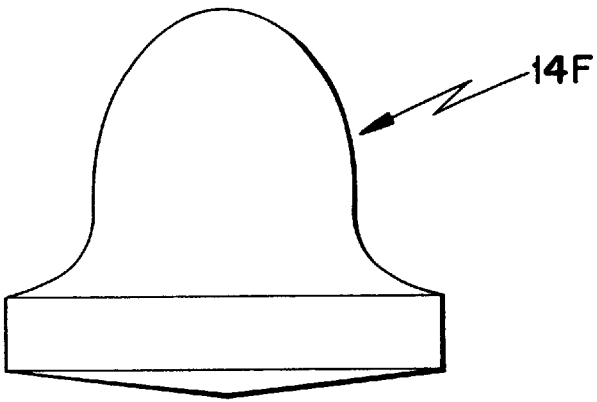

FIG. 7 shows a button 14C according to the present invention, with a ballistic basic form, which is somewhat more aggressive than the above-described buttons. FIG. 8 shows a button 14D according to the present invention, with a conical basic form, which is still more aggressive than the above-described buttons. FIG. 9 shows a button 14E according to the present invention such as mentioned above, with an asymmetrical, essentially conical basic form. As is evident from FIG. 10, the button 14F according to the present invention is formed with a shoulder and an intermediate concave portion. The shoulder protects the surrounding steel in the head portion 11 from wear and gives bigger welded surface.

Alternatively the buttons 14A–14F may be formed of material similar to the type of hard metal which is described in U.S. Pat. No. 5,286,549, wherein is shown hard metal bodies, which contain WC and a binder based on at least one of Co, Fe and Ni and which includes a soft core of hard metal surrounded by a harder surface zone of hard metal. It is understood that the buttons 14C–14F can be provided with a tip 22 to enable capacitor discharge spot welding of these buttons.

The present invention consequently brings about a rock drill bit for percussive rock drilling which allows a large degree of freedom regarding the size and location of cavities such as flush channels in the drill body. In addition, button geometries are provided and a method that enables a simple and quick mounting of the button to the drill body, which in turn provides material technical advantages.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A rock drill bit for percussive drilling comprising a bit body having a working end formed by a forward surface and a surrounding peripheral surface, peripheral buttons arranged in the peripheral surface in the form of a peripheral wreath of peripheral buttons, front buttons arranged in the forward surface inside of the wreath of peripheral buttons, at least one of the front buttons having a rear end forming a metallurgical bond with a substantially flat forwardly facing portion of the forward surface, the at least one front button having a protruding portion which protrudes from the forward surface, the protruding portion having a diameter D and a height H, wherein H/D<1.2, the metallurgical bond substantially corresponding to a rear end of the protruding portion.

2. A button adapted to be mounted on a forward surface of a rock drill bit for percussive drilling, the button formed of hard metal and having an operative working end intersected by a center axis of the button, the button having a lower side defined by a rearwardly projecting tip, and a protruding portion protruding forwardly from the tip, the protruding portion having a maximum diameter D and a height H, wherein D>H, and H/D is the range of 0.4 to 0.7; the tip being at least partly conical.

3. The button according to claim 2 wherein the tip extends symmetrically about the center axis.

4. The button according to claim 2 wherein the lower side is substantially conically shaped and has an internal cone angle in the range of 150° to less than 180°.

5. The button according to claim 2 wherein the operative working end is defined by a radius whose center lies in a plane extending perpendicular to the center axis, a distance from the lower side to the plane being not greater than 15 mm.

6. The button according to claim 5 wherein the distance is from 0.2 to 2.8 mm.

* * * * *